United States Patent [19]

Massaro

[11] Patent Number: 5,068,927

[45] Date of Patent: Dec. 3, 1991

[54] REPLACEMENT SEAT FOR SANITARY CHAIRS

[75] Inventor: Bruno A. Massaro, 1534 Dunbar Hill Rd., Hamden, Conn. 06514

[73] Assignees: Bruno A. Massaro; Thomas Tolisano, both of Hamden; Hank Bolden, New Haven, all of Conn.

[21] Appl. No.: 568,206

[22] Filed: Aug. 16, 1990

[51] Int. Cl.[5] ..... A47K 11/00

[52] U.S. Cl. ..... 4/480; 4/483; 297/DIG. 2

[58] Field of Search ..... 4/254, 460, 478, 479, 4/480, 483, 484, 465, 476, 485, 235, 239; 297/416, 421, 444, 457, DIG. 2, DIG. 4

[56] References Cited

U.S. PATENT DOCUMENTS

| | | | |
|---|---|---|---|
| 799,504 | 9/1905 | Turner | 4/483 |
| 2,662,229 | 12/1953 | Wenkstern | 4/476 |
| 2,670,787 | 3/1954 | Vandas et al. | 297/457 X |
| 2,788,846 | 4/1957 | Hauser | 297/457 X |
| 2,804,121 | 8/1957 | Singleton | 4/483 |
| 2,940,086 | 6/1960 | Wondrack | 4/239 |
| 3,146,028 | 8/1964 | Grosfillex | 297/457 X |
| 3,258,291 | 6/1966 | Ezquerra | 4/483 X |
| 3,343,179 | 9/1967 | Sellars, Jr. et al. | 4/476 |
| 3,393,941 | 7/1968 | Grosfillex | 297/457 X |
| 3,596,986 | 8/1971 | Ragsdale | 297/457 X |
| 3,629,874 | 12/1971 | Beller | 4/483 X |
| 3,971,077 | 7/1976 | O'Neil | 4/239 |
| 4,287,619 | 9/1981 | Brewer et al. | 4/483 |
| 4,446,585 | 5/1984 | Harding et al. | 4/460 |
| 4,609,225 | 9/1986 | Loucks | 297/457 X |

FOREIGN PATENT DOCUMENTS

| | | | |
|---|---|---|---|
| 579390 | 7/1958 | Italy | 297/457 |

*Primary Examiner*—Henry J. Recla
*Assistant Examiner*—Robert M. Fetsuga
*Attorney, Agent, or Firm*—Bachman & LaPointe

[57] ABSTRACT

A replacement seat is disclosed for a commode chair for immobile or substantially immobile persons. The replacement seat is a rigid, integrally molded combination seat and backrest sized to retrofit existing chair frames. The seat is attached to the frame either by means of lips on the seat which frictionally grasp the frame, or by a manually releasable locking mechanism.

17 Claims, 2 Drawing Sheets

REPLACEMENT SEAT FOR SANITARY CHAIRS

BACKGROUND OF THE INVENTION

1. Field of the Invention

This invention relates generally to replacement seats for chairs for immobile or substantially immobile persons, and more specifically to an easily installable, readily detachable, integrally molded seat and backrest combination having a toilet opening. The replacement seat is adapted to retrofit existing chairs whose seats which are worn or otherwise unfit.

2. Description of the Prior Art

Generally speaking, there are a variety of chairs in use for assisting the elderly and infirm with their locomotion and sanitary needs. The most common type of chair is the ordinary wheelchair or collapsible wheelchair. Other types of chairs include sanitary chairs, commode chairs, and shower chairs.

A typical chair has an aluminum or plastic frame and a seat composed of either a flexible material, as on a wheelchair, or a rigid plastic. Many chairs also have a backrest composed of a rigid plastic material, or a flexible material such as nylon, separate from the seat. When used as a toilet chair, the seat will often contain a toilet opening. Some chairs are designed to be used without a toilet, and include a commode receptacle to collect the waste from the toilet opening.

Typical toilet chairs and replacement seats are exemplified by the following references:

Stoute, U.S. Pat. No. 4,296,506 teaches a flexible seat for a collapsible wheelchair. This replacement seat includes a toilet opening a removable receptacle designed to fit below the opening, and a flap to close the opening when it is not in use.

Allen, U.S. Pat. No. 4,837,868 discloses a toilet device including a chair frame with a toilet seat, and a commode receptacle mounted below the opening. The commode receptacle has an access port to provide for cleaning of the patient seated on the seat.

James, U.S. Pat. No. 4,177,528 is a sanitary chair with a toilet seat, and movable arm rests. These movable arm rests allow easy entry to the chair by a person in a wheelchair.

Love, U.S. Pat. No. 4,587,678 and Hynson, U.S. Pat. No. 4,428,615 disclose still other variations of toilet chairs.

These devices suffer from a variety of drawbacks. Most toilet chairs are very uncomfortable, having generally a very skimpy construction. Often, the chairs do not even have a backrest. This further discomforts the patient, who is already in an undignified situation.

Further, many seats and backrests are constructed of flexible material. As flexible materials provide little support, they are particularly awkward to sit on when used for toilets. Moreover, as flexible materials become wet, as toilet chairs often do, they become even more uncomfortable, and may harbor bacteria or disease. Finally, flexible materials, especially fabric such as canvas, are particularly difficult to clean and dry.

A further drawback of flexible seats is that they are difficult to replace. If a seat or backrest become worn, it may be necessary to cut the old material off before replacing it, and often, replacement flexible parts are not available. It would thus be necessary to discard a chair with worn parts if no replacements were available.

Even on chairs with available replacement parts, replacing these parts may be difficult, requiring special tools or techniques.

One object of the present invention is to provide a replacement seat for invalid chairs which is designed to retrofit existing chair frames.

Yet another object is to provide a seat as above which is sturdy, durable, easy to clean and dry, waterproof, and does not harbor disease.

A further object of the present invention is to provide such a seat which is easily installable and removable by an ordinary person with few tools, if any. The seats should also be stackable, so they may be stored in a smaller space for institutional applications.

A still further object of the invention is to provide a replacement seat which is comfortable to sit on. These and other objects and advantages will become more apparent from the following description and drawings.

SUMMARY OF THE INVENTION

The foregoing objects are achieved by the replacement seat of the present invention. In accordance with the present invention, a replacement seat is provided for toilet chairs for immobile or substantially immobile persons. The seat comprises an integrally formed, combination seat and backrest with toilet opening. Both the seat and the backrest are molded so as to provide a comfortable contoured shape. Additionally, the seats are sized to retrofit existing chair frames.

The seats of the present invention may be easily fitted to existing chair frames by a frictional engagement means which allows the seat to be attached to the frame by applying a small downward pressure to the seat, thus, making the invention installable by ordinary persons. In an alternative embodiment of the present invention, the seat is secured by inserting a bolt through the seat and frame, then tightening a nut onto the bolt. As a result of this construction, only common handtools are required to accomplish the installation. Still further, the replacement seat may be used with chairs constructed of flexible material, without having to remove the worn materials at all, since the invention will cover the old fabric.

Replacement seats in accordance with the present invention are constructed from a rigid material, such as plastic or fiberglass It has been found that forming the seat from these materials allows the seat to be readily and easily cleaned and dried. Additionally, seats formed from these materials are waterproof.

The contoured backrest and seat also make the seat more comfortable, and thus less of an indignity to the user. Additionally, the seats are constructed so that they may be stacked, and therefore stored in a limited space.

DESCRIPTION OF THE PREFERRED EMBODIMENT

Figure 1:
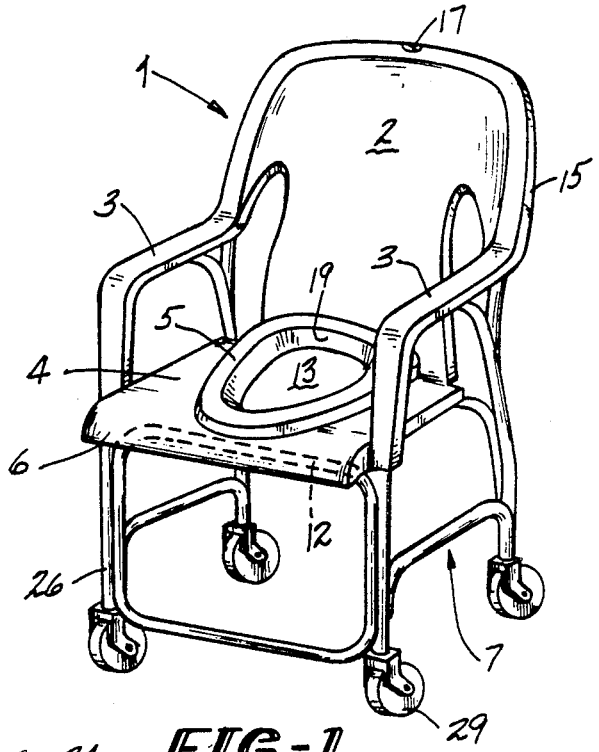
FIG. 1 shows a perspective view of a replacement seat installed in a frame in accordance with the invention.

As shown in FIG. 1 the replacement seat 1 includes an approximately horizontal seat portion 4 and an integrally molded upright backrest portion 2. Centrally located on seat portion 4, is a raised portion forming a toilet seat 5. An approximately circular toilet opening 13 is located at the center of the toilet seat 5, and extends through seat portion 4. The seat 1 also has integral armrests 3 located above seat portion 4.

The primary surfaces of the seat 1, including seat portion 4, toilet seat 5, backrest portion 2, armrests 3 and front edge 6 are all contoured to more easily conform to the human body and thus provide comfort to the user. The seat 1 is composed of a rigid material such as plastic or fiberglass so that it will be durable, easy to clean and waterproof. Additionally, seat 1 has no crevices, cracks or hinges to harbor bacteria or germs.

Figure 2:
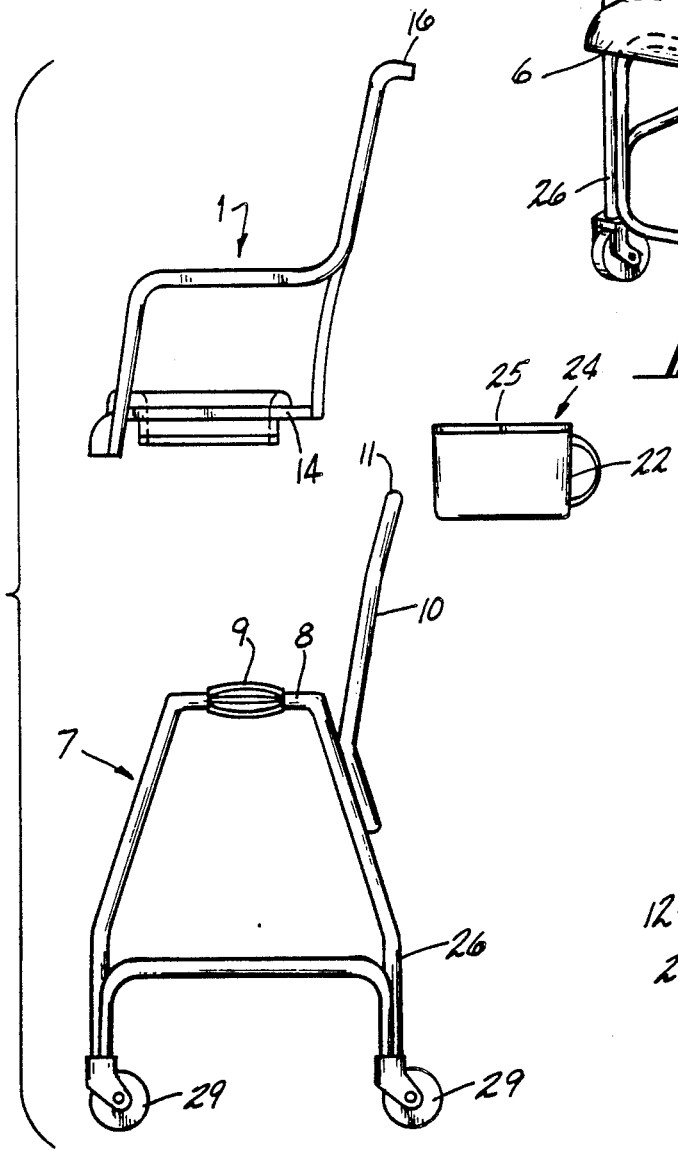
FIG. 2 shows an exploded side view of the invention and a typical chair frame.

As shown in FIG. 2, Seat 1 is sized to retrofit existing chair frames such as frame 7 composed of hollow aluminum or aluminum alloy tubing. A typical frame such as frame 7 has a backrest frame portion 10 which provide support for the back of the person sitting in the chair, a seat frame portion 12 which provides support for the sitting surface of the chair, and legs 26 to support the entire chair. A typical frame further includes armrest frames 8 to support the arms of the person sitting in the chair, and may incorporate grips 9 surrounding the armrest frames 8 for comfort. Since the chair is used for immobile persons, wheels 29 may be provided for mobility.

Extending downward from the peripheral edges of seat portion 4 are molded lips 14. These lips 14 engage the seat frame 12 to position the seat on the frame and prevents relative movement between the two. The lips also serve to provide support for the sitter. Likewise, extending backward from the backrest portion 2 of seat 1 are molded lips 15 which engage the backrest frame 10 to support the seat 1 and prevent relative motion.

Figure 5:
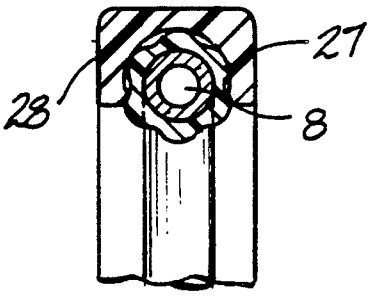
FIG. 5 shows a partial cross-sectional view of the invention through 5—5.

As shown in FIG. 5, in order to secure the seat 1 to frame 7, armrests 3 include downwardly extending lips 27 and 28 on opposite sides of armrest 3. The lips are substantially parallel to each other and substantially parallel to armrest frame 8. The lips 27 and 28 are spaced apart a distance slightly less than the longitudal diameter of armrest frame 8, so that when pressure is applied to armrest 3 from above, lips 27 and 28 will expand slightly, allowing the armrest 3 to snap onto armrest frame 8 and to be frictionally secured thereto. When necessary, the seat 1 can be detached from frame 7 by merely applying a small upward pressure to seat 1 until the frictional grip is released. It is further contemplated that such a snapping mechanism could be located at other locations on seat 1, such as, for example, at top edge 11 of frame 7.

Figure 6:
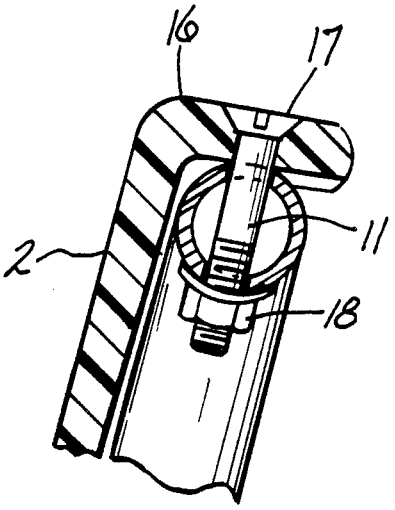
FIG. 6 shows a partial cross-sectional view of the invention through 6—6.

Seat 1 may also be attached to frame 7 by means of a manually releasable lock mechanism as shown in FIG. 6. For example, backward facing lip 16 from backrest portion 2 may be secured to frame 7 by inserting a bolt 17 through a hole in top edge 11 and a hole in the frame, and securing the bolt 17 with nut 18. This embodiment provides a very secure attachment of replacement seat 1.

Figure 3:
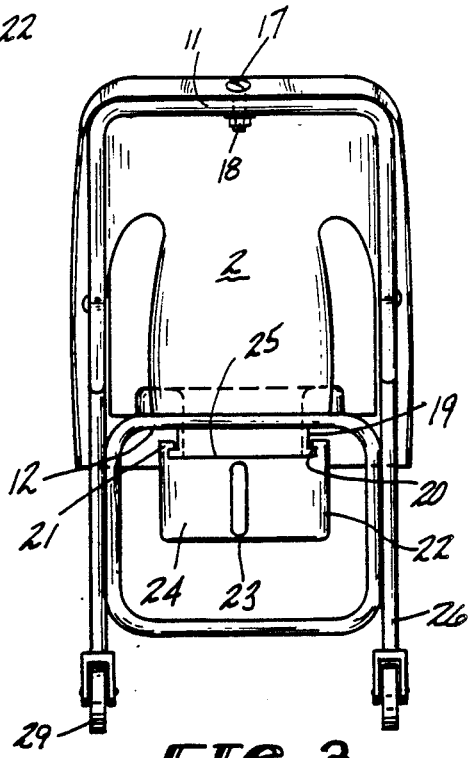
FIG. 3 shows a rear view of the invention installed in a frame.
Figure 4:
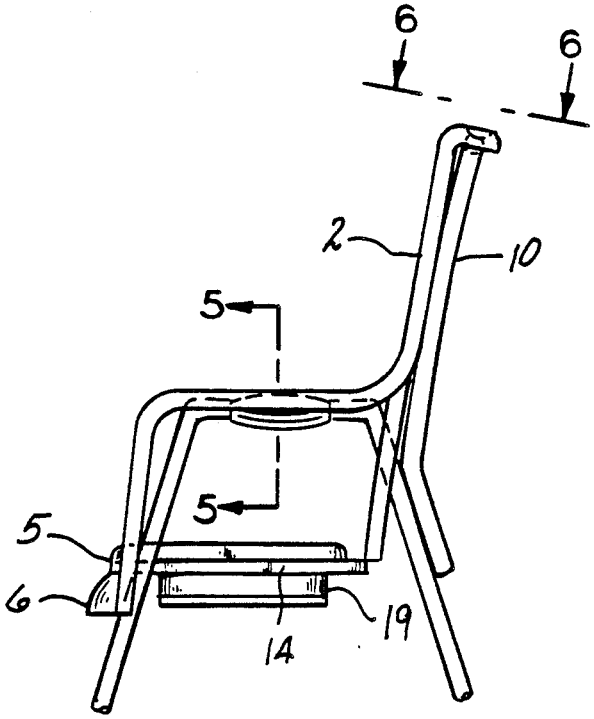
FIG. 4 shows a partial side view of the invention.

As certain chairs are designed to be used self-standing, i.e. not in conjunction with a toilet, this invention contemplates employing a waste receptacle 24 to receive waste through toilet opening 13 as shown in FIG. 3. Toilet opening 13 is defined by downwardly extending walls 19 which terminate at an outwardly extending molded lip 20. Waste receptacle 24 is characterized by a closed bottom 23 with walls 22 extending vertically upward terminating at an inwardly extending lip 21. The top 25 of waste receptacle 24 is open to receive waste. Waste receptacle 24 is sized so that inwardly extending lip 21 will engage outwardly extending lip 20 when waste receptacle 24 is slidingly placed below toilet opening 13.

In practice, the method of replacing a worn or otherwise unfit seat would comprise essentially the following steps:

Firstly, the worn backrest would be removed. For a typical chair with a flexible backrest, the flexible material would be cut from the frame. It is sometimes possible to leave the worn material in place, since the replacement seat of the present invention may cover the old material.

Next, the old toilet seat would be removed. Often, these are screwed onto the frame, and thus the screws must be removed. However, as with the backrest, there are a variety of techniques used to secure the seat to the frame.

Finally, the replacement seat of the invention is aligned with the chair frame and secured to it by either snapping the seat onto the frame, or by manually securing it. Using the snapping method, the seat would be placed in contact with the frame such that the lips on the armrests of the seat contacted the armrest frames. Next, the armrests and armrest frames would be grasped, while a downward pressure is applied to the seat. This downward pressure causes the lips to separate so that the seat firmly grasps the frame.

Alternatively, a bolt could be applied through a hole in the seat and the frame and secured with a nut, to mechanically attach the seat to the frame. It is anticipated that other methods for manually attaching the seat to the frame may be implemented. While the present invention has been described in the context of a replacement seat for sanitary chairs for immobile persons, it should be recognized that the seat of the present invention has utility in other applications. For example, a modified seat without the toilet opening and/or armrests could be used to refurbish lawn chairs. Likewise, other variations and modifications exist which are within the scope of the invention as defined in the following claims.

What is claimed is:

1. A replacement seat for a chair for immobile or substantially immobile persons having a frame member which comprises:

an integrally molded backrest and seat member of substantially rigid construction adapted to retrofit said frame member, said seat member comprises a seat platform, a toilet seat integrally molded to the seat platform and raised therefrom wherein said toilet seat has a substantially central toilet opening extending downward through said seat platform; and means for removably securing said integrally molded back rest and seat member to said frame member.

2. A replacement seat according to claim 1 wherein said means for removably securing said integrally molded backrest and seat member comprises means for frictionally engaging said integrally molded backrest and seat member to said frame member.

3. A replacement seat according to claim 1 wherein said means for removably securing said integrally molded back rest and seat member comprises a manually releasable lock mechanism.

4. A chair for immobile or substantially immobile persons which comprises the combination of:

a frame member having a plurality of legs, a seat frame mounted substantially horizontally on said legs, and a back support frame extending substantially vertically upward from said seat frame and having a top edge; and a substantially rigid, integrally molded seat and backrest member removably secured to said frame member, said seat and backrest member having a seat portion with peripheral edges and a backrest portion with peripheral edges, said seat portion further comprises a seat platform located above said seat frame and supported thereby, and a toilet seat integrally molded to said seat platform and raised therefrom, said toilet seat having a substantially central toilet opening extending downward through said seat platform.

5. Apparatus according to claim 4 further comprising means for facilitating movement of said chair.

6. Apparatus according to claim 4 wherein said toilet opening is defined by substantially vertical walls molded to said toilet seat and extending downward therefrom.

7. Apparatus according to claim 6 including said walls having a lower edge and a molded lip extending outward from said lower edge.

8. Apparatus according to claim 7 including a commode receptacle having an open top with a top edge and a closed bottom with sidewalls extending upward from said bottom, and a molded lip extending inwardly from the top edge of the open top sized to engage said lip extending outward from the lower edge of said vertical walls.

9. Apparatus according to claim 4 wherein said molded seat and backrest further comprises a molded lip extending substantially downward from the peripheral edges of said seat portion firmly engaging said seat frame, and a molded lip extending substantially backward from the peripheral edges of said backrest portion firmly engaging the top edge of said seat frame;

said lips providing support for said seat and backrest member.

10. Apparatus according to claim 4 wherein said frame member further comprises arm rest frames located on opposing sides of said seat frame, and upwards therefrom, extending substantially perpendicular to said backrest portion; and said seat and backrest member further comprises molded arm rests, having lips extending downward and spaced to frictionally engage said arm rest frames.

11. Apparatus according to claim 4 wherein said seat and backrest member is comprised of plastic material.

12. Apparatus according to claim 4 wherein said seat and backrest member is comprised of fiberglass material.

13. Apparatus according to claim 4 wherein said seat and backrest member is substantially waterproof and easily cleanable, and said backrest portion is contoured.

14. Apparatus according to claim 4 wherein said frame member is comprised substantially of aluminum and aluminum alloys.

15. A chair for immobile or substantially immobile persons which comprises the combination of:

a frame member having a plurality of legs, a seat frame mounted substantially horizontally on said legs, and a back support frame extending substantially vertically upward from said seat frame and having a top edge wherein said frame member further comprises arm rest frames located on opposing sides of said seat frame, and upwards therefrom, extending substantially perpendicular to said backrest portion; and a substantially rigid, integrally molded seat and backrest member removably secured to said frame member, said seat and backrest member having a seat portion with peripheral edges and a backrest portion with peripheral edges said seat and backrest member further comprises molded arm rests, having lips extending downward and spaced to frictionally engage said arm rest frames.

16. Apparatus according to claim 15 wherein said seat portion further comprises a seat platform located above said seat frame and supported thereby, and a toilet seat molded to said seat platform and raised therefrom, said toilet seat having a substantially central toilet opening extending downward through said seat platform.

17. Apparatus according to claim 15, including grip coverings on said arm rest frames.

* * * * *